US011211685B2

(12) United States Patent
Gannon et al.

(10) Patent No.: US 11,211,685 B2
(45) Date of Patent: Dec. 28, 2021

(54) ELECTRICALLY NEUTRAL BODY CONTOURING ANTENNA SYSTEM

(71) Applicant: Harris Global Communications, Inc., Rochester, NY (US)

(72) Inventors: Joshua S. Gannon, Fairport, NY (US); Joseph D. Majkowski, Pittsford, NY (US); William A. Christiano, Avon, NY (US); Gregory G. Ornt, Sodus Point, NY (US)

(73) Assignee: HARRIS GLOBAL COMMUNICATIONS, INC., Rochester, NY (US)

( * ) Notice: Subject to any disclaimer, the term of this patent is extended or adjusted under 35 U.S.C. 154(b) by 0 days.

(21) Appl. No.: 16/706,306

(22) Filed: Dec. 6, 2019

(65) Prior Publication Data

US 2021/0175601 A1 Jun. 10, 2021

(51) Int. Cl.

| | |
|---|---|
| ***H01Q 1/12*** | (2006.01) |
| ***H01Q 1/08*** | (2006.01) |
| ***H01Q 15/16*** | (2006.01) |
| ***H01Q 9/34*** | (2006.01) |
| ***H01Q 1/20*** | (2006.01) |

(52) U.S. Cl.

CPC ..... *H01Q 1/1235* (2013.01); *H01Q 1/08* (2013.01); *H01Q 1/1207* (2013.01); *H01Q 1/20* (2013.01); *H01Q 9/34* (2013.01); *H01Q 15/161* (2013.01)

(58) Field of Classification Search

CPC ..... H01Q 1/1235; H01Q 1/08; H01Q 15/161; H01Q 1/273; H01Q 9/20; H01Q 1/10; H01Q 1/085

USPC ..... 343/915, 900

See application file for complete search history.

(56) References Cited

U.S. PATENT DOCUMENTS

| | | | | |
|---|---|---|---|---|
| 2,094,475 A * | 9/1937 | Schwarzhaupt | ..... | H01Q 1/085 343/752 |
| 2,379,577 A * | 7/1945 | Harsted | ..... | H01Q 1/10 52/110 |
| 3,268,898 A * | 8/1966 | Colony | ..... | H01Q 1/10 343/723 |
| 3,669,133 A * | 6/1972 | Hyman | ..... | A45B 9/00 135/74 |
| 5,638,594 A | 6/1997 | Shinkawa et al. | | |
| 6,018,325 A * | 1/2000 | Lundgren | ..... | E04H 12/16 343/878 |

(Continued)

OTHER PUBLICATIONS

Extended European Search Report issued in EP 20211482.3 dated May 6, 2021.

*Primary Examiner* — Hai V Tran
*Assistant Examiner* — Yonchan J Kim
(74) *Attorney, Agent, or Firm* — Fox Rothschild LLP; Robert J. Sacco; Carol E. Thorstad-Forsyth

(57) ABSTRACT

Antenna system includes a base structure and a multiplicity of vertebrae arranged in a stack to define a spine. The spine has an elongated length which extends from a base end to a tip end. A compression applicator is configured to apply an elastic compression force on the stack in a direction along the elongated length from the tip end to the base end. Vertebra interfaces associated with each of the adjacent pairs of the vertebrae are configured to facilitate a variable deviation in an angular alignment of a vertebra axis of each vertebra relative to an adjacent one of the vertebra contained in the stack.

26 Claims, 7 Drawing Sheets

(56) References Cited

U.S. PATENT DOCUMENTS

| | | | | |
|---|---|---|---|---|
| 6,362,793 | B1 * | 3/2002 | Sawamura | H01Q 1/243 343/702 |
| 6,460,795 | B1 * | 10/2002 | Brown, Jr. | B65H 75/38 191/12.2 R |
| 6,618,025 | B2 | 9/2003 | Harless | |
| 6,689,003 | B2 | 2/2004 | Wigsten et al. | |
| 6,919,850 | B2 | 7/2005 | Kennedy et al. | |
| 6,940,462 | B2 | 9/2005 | Packer | |
| 7,250,027 | B2 | 7/2007 | Barry | |
| 7,755,553 | B2 | 7/2010 | Packer et al. | |
| 8,421,753 | B2 | 4/2013 | Zucker et al. | |
| 8,599,098 | B1 * | 12/2013 | Marshall | H01Q 1/085 343/888 |
| 8,931,748 | B2 | 1/2015 | Bowman et al. | |
| 9,209,514 | B2 | 12/2015 | Sivalingam | |
| 9,510,846 | B2 | 12/2016 | Sholev et al. | |
| 9,711,859 | B1 * | 7/2017 | Muesse | H01Q 1/273 |
| 10,892,545 | B1 * | 1/2021 | Parsche | H01Q 1/12 |
| 2009/0051609 | A1 * | 2/2009 | Packer | H01Q 9/16 343/718 |
| 2009/0112251 | A1 | 4/2009 | Qian et al. | |
| 2010/0275821 | A1 | 11/2010 | Lebel et al. | |
| 2014/0260014 | A1 | 9/2014 | Smith | |
| 2016/0181686 | A1 | 6/2016 | Harmelink et al. | |

* cited by examiner

ELECTRICALLY NEUTRAL BODY CONTOURING ANTENNA SYSTEM

BACKGROUND

Statement of the Technical Field

The technical field of this disclosure concerns antennas, and more particularly elongated lightweight deployable antennas that are capable of conforming to a desired shape for stowage and transport.

Description of the Related Art

Various types of antennas are used for man-portable and/or dismounted communication operations. Some of these antennas are body-worn antennas which can be conveniently attached to a body of a person to facilitate portable communications in support of dismounted military operations. Conventional antennas which can be used for this purpose may include various types of linear antennas (e.g., a monopole vertical antenna, or a vertical dipole). For example, linear antennas used in such applications are sometimes formed of a bi-stable blade comprised of spring steel or a composite material. As is known, a bi-stable blade will exhibit two stable configurations, including one configuration in which the blade is deployed to form a rigid elongated structure. Linear antennas used in such applications can also be formed from conventional flexible metal tubing, which is sometimes referred to as flexible gooseneck tubing. Further, a conductive metal wire can be used in some applications to form a deformable linear antenna. Antennas formed of each of these types of structures are known to have certain drawbacks, particularly when applied to the field of body worn antennas.

More complex antennas can sometimes require an electrically neutral support element, in which case a spring steel blade is not a satisfactory means of supporting the antenna. Bi-stable blades formed from composite materials can be relatively expensive for consideration in many antenna applications. Antennas formed of conventional flexible metal tubing (e.g., flexible gooseneck tubing) can also suffer from various limitations. These limitations can include relatively high weight, a somewhat poor ability to conform to a particular shape, and relatively high expense. Antennas formed from flexible metal tubing also lack a quick release ability to facilitate automatically returning the antenna to a linearly deployed configuration after the antenna has been stowed or conformed to a particular non-linear shape. Other types of antennas such as patch antennas can be unsuitable for many applications due to their directional radiation patterns.

SUMMARY

This document concerns an antenna system. The antenna system is comprised of a base structure and a multiplicity of vertebrae arranged in a stack to define a spine. The spine has an elongated length extending from a base end, which is closer to the base structure, to a tip end that is distal from the base structure. One or more elongated antenna elements are supported on a portion of the elongated length of the spine. In some scenarios, the base structure can also comprise a radiating element.

The antenna system also includes a compression applicator which is configured to apply a compression force on the spine in a direction along the elongated length from the tip end to the base end. Each of the vertebra includes a superior face and an inferior face which are respectively disposed on opposing ends of a vertebra body defining a vertebra axis. The inferior face of each vertebra has an inferior face profile which is shaped to receive the superior face of an adjacent one of the vertebra when the multiplicity of vertebrae are arranged in the stack. As such, the superior face and the inferior face define a vertebra interface which is configured to facilitate a variable deviation in angular alignment of the vertebra axis of each vertebra relative to an adjacent one of the vertebra in the stack when the spine is subjected to a deflecting force. An elongated flexible member which extends adjacent the vertebrae along the elongated length of the spine is configured to limit the variable deviation.

The variable deviation in angular alignment as described herein is configured to facilitate a resilient deflection of the spine. This resilient deflection involves a transition from a linear alignment in which the vertebra axis of each vertebra is aligned along a linear axis defined by the spine, to a curved alignment in which the vertebra axis of each vertebra is tangentially aligned along a curved path defined by the spine. According to one aspect, the compression applicator is configured to return the spine to the linear alignment after the deflecting force is eliminated.

In a solution described herein, the superior face and an inferior face which are respectively disposed on opposing ends of the vertebra body each has a predetermined shape. The superior face profile is advantageously selected to be convex, V-shaped or U-shaped. The superior face and the inferior face can be complementary shapes so that the superior face of a first vertebra will fit snugly into the inferior face of an adjacent second vertebra in the stack.

According to one aspect, the compression force is advantageously comprised of an elastic force. Further, the compression applicator can be comprised of a cord which extends along the elongated length of the spine. The cord extends through a cord guide defined in each vertebra of the multiplicity of vertebrae. The compression applicator includes a resilient element secured to the cord. This resilient element is configured to apply an elastic force which maintains the cord under a condition of tension. In some scenarios, the resilient element is a spring, which is secured to the base. In other scenarios, the cord can be comprised of an elastic material to provide the elastic force.

The antenna also includes an antenna feed network. The antenna feed network is advantageously disposed within a feed housing that is secured to the base, and the spine is advantageously supported on the housing. The feed network can be coupled to a first antenna element extending along a portion of the elongated length of the spine. The antenna feed network can also be coupled to a second antenna element, so that the first and second antenna elements together comprise a dipole antenna. According to one aspect, the second antenna element can be comprised of the base structure. Accordingly, the base structure can provide a dual function of securing the resilient element and can also function as an antenna element.

In some scenarios, the first antenna element is supported on a first portion of the elongated length of the spine, and a second antenna is supported on a second portion of the elongated length of the spine. Such an arrangement can be useful to facilitate a vertical dipole configuration. For example, the second antenna can be comprised of a vertical dipole antenna. To facilitate feeding of the second antenna, each vertebra can define a feed channel. The feed channel is configured to receive a portion of an RF feed line which extends along a portion of the elongated length of the spine between the antenna feed and the second antenna.

BRIEF DESCRIPTION OF THE DRAWINGS

This disclosure is facilitated by reference to the following drawing figures, in which like reference numerals represent like parts and assemblies throughout the several views. The drawings are not to scale and are intended for use in conjunction with the explanations in the following detailed description.

DETAILED DESCRIPTION

Figure 1A:
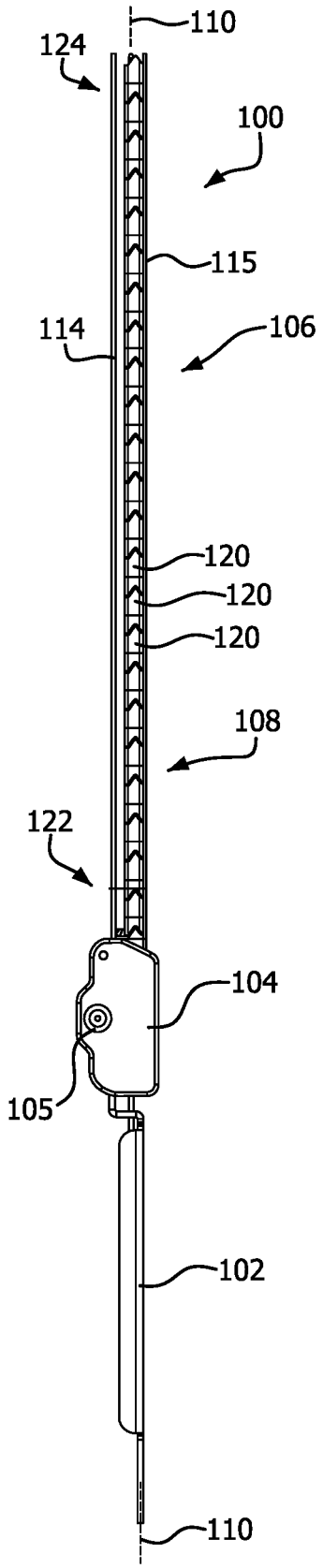
FIGS. 1A-1C are useful for understanding certain aspects of an extendable antenna that can be contoured to a desired shape.

It will be readily understood that the solution described herein and illustrated in the appended figures could involve a wide variety of different configurations. Thus, the following more detailed description, as represented in the figures, is not intended to limit the scope of the present disclosure, but is merely representative of certain implementations in various different scenarios. Further, particular features described herein can be used in combination with other described features in each of the various possible combinations and permutations. It is noted that various features are described in detail with reference to the drawings, in which like reference numerals represent like parts and assemblies throughout the several views. While the various aspects are presented in the drawings, the drawings are not necessarily drawn to scale unless specifically indicated.

The methods and/or systems disclosed herein may provide certain advantages in a scenario where an extendable antenna system is supported by a human body. Such an antenna, which is sometimes referred to as a wearable antenna, can be advantageously made so that an elongated extendable antenna element is easily conformable or adjustable to a desired shape. For example, in some scenarios it can be desirable to conform or adjust a shape of an extendable elongated antenna to conform to a portion of a human body. One advantage of the system described herein is that the antenna support structure is comprised of electrically neutral elements. Consequently, the support structure will have little or no interaction with the radiating elements comprising the antenna. A further advantage of the disclosed solution is that the antenna will deform in response to applied external forces, but will resiliently return to its linear form when the external force is removed.

Figure 1B:
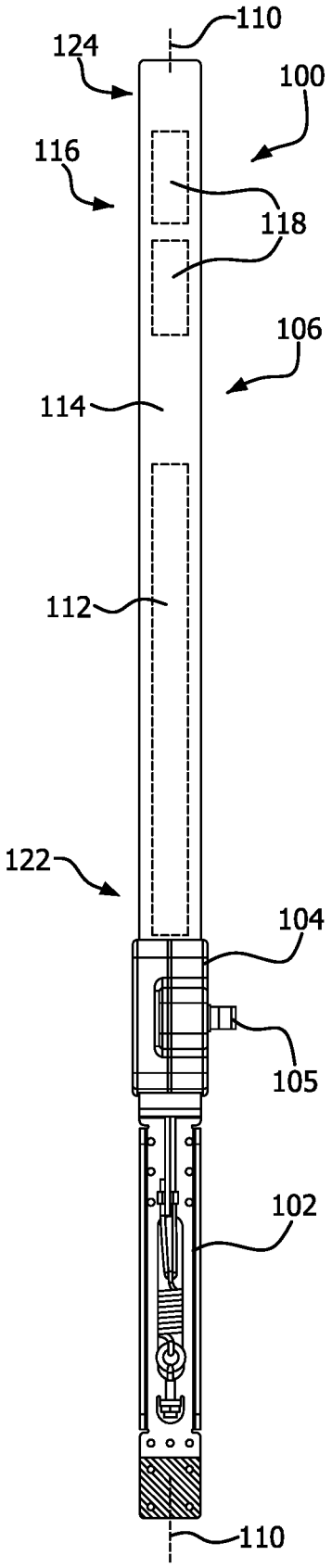
Figure 1C:
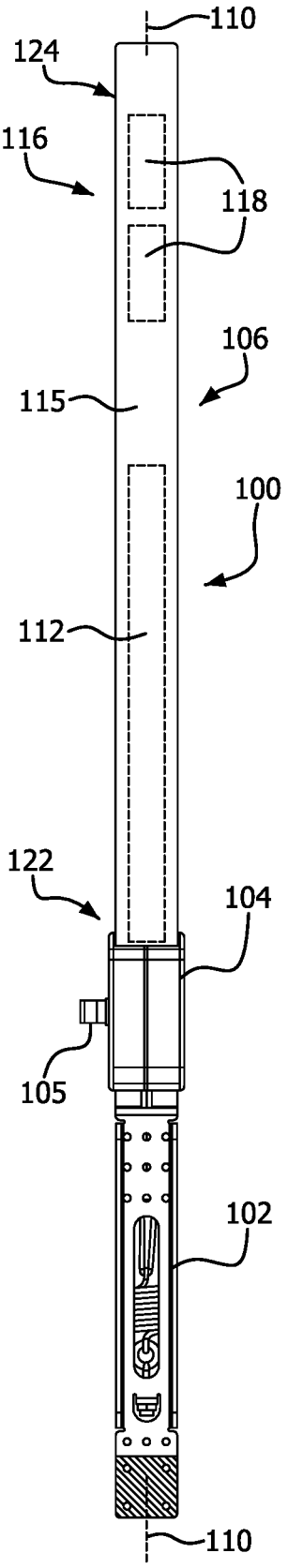

Referring now to FIGS. 1A-1C it can be observed that an antenna system 100 can be comprised of a base structure 102, a housing 104 that encases and protects certain electrical components is secured to the base structure, and an elongated extendable antenna structure (EEAS) 106. In some scenarios, the EEAS 106 can be supported on the housing 104 as shown. The EEAS is comprised of a multiplicity of vertebrae 120 which are arranged in a stack to define a spine 108. As may be understood with reference to FIG. 1A, the spine 108 has an elongated length extending from a base end 122, closer to the housing 104, to a tip end 124 that is distal from the housing 104. An RF feed port 105 is disposed on the housing.

One or more antenna radiating elements 112, 118 which are electrically coupled to the feed port 105 can be supported on the spine 108 to facilitate antenna operations. In some scenarios described herein, the base structure 102 can also serve as a radiating element of the antenna. In such a scenario, the radiating element formed by the base structure 102, and the radiating element 112 can together comprise a low band antenna. For example, the base structure 102 and the radiating element 112 may comprise two separate radiating elements of a low band vertical dipole. In some scenarios, radiating elements 118 can comprise a separate high band antenna 116. For example, radiating elements 118 may comprise a high band vertical dipole.

Figure 2A:
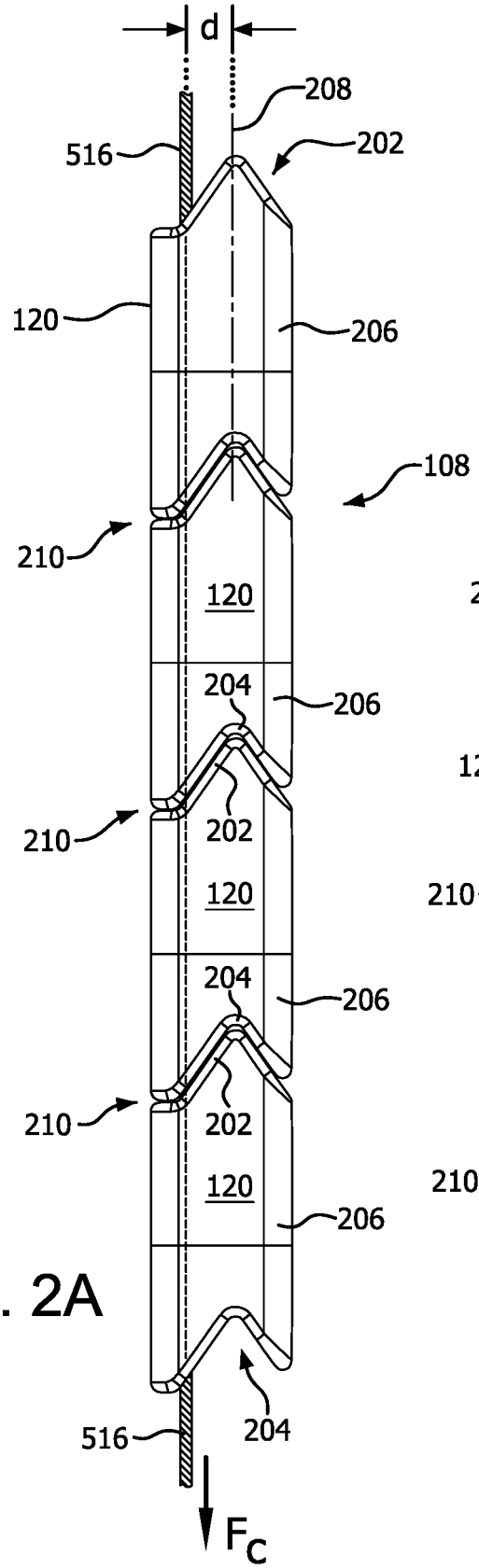
FIGS. 2A and 2B are a series of drawings that are useful for understanding the way in which an antenna support structure can flex when comprised of a stack of vertebrae.
Figure 2B:
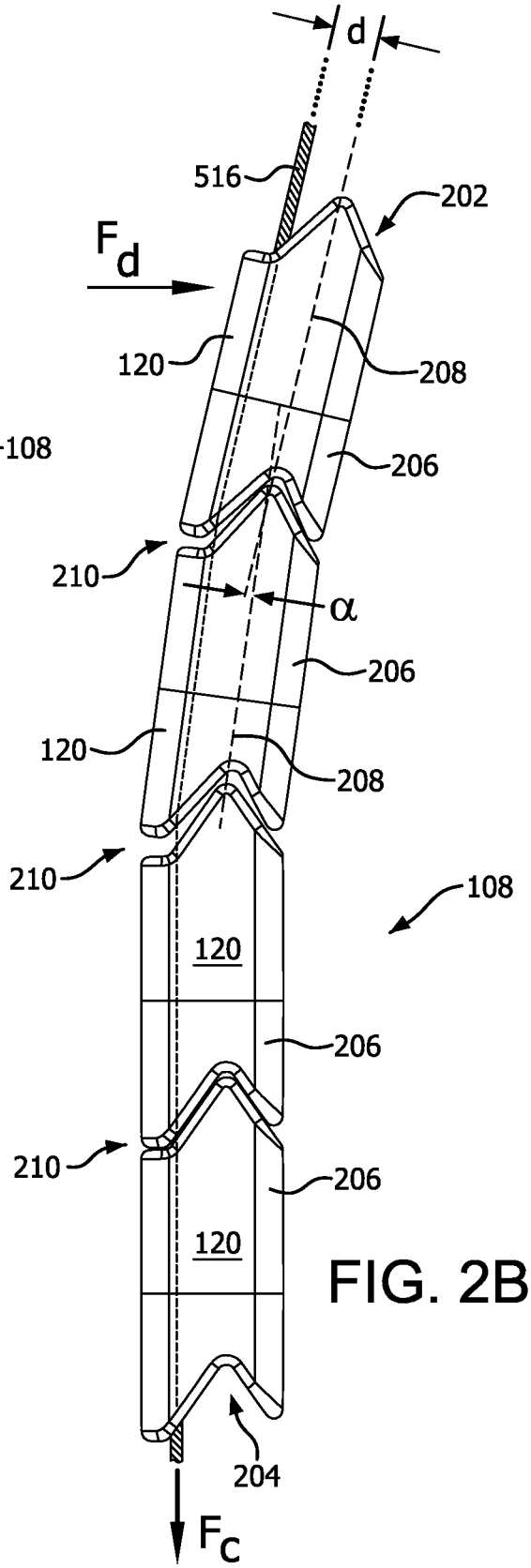

The operation of the spine 108 will now be described in further detail. A compression applicator (not shown in FIG. 1A-1C) is configured to apply a compression force $F_c$ on the stack of vertebrae 120 which form the spine 108. This concept is illustrated in FIGS. 2A and 2B. When the EEAS 106 is fully extended, this compression force $F_c$ is aligned in a direction along the elongated length of the spine from the tip end 124 to the base end 122. As shown, each vertebra 120 comprising the spine 108 includes a superior face 202 and an inferior face 204. These faces are respectively disposed on opposing ends of a vertebra body 206 which defines a vertebra axis 208. It may also be observed in FIGS. 2A and 2B that the inferior face 204 of each vertebra has an inferior face profile which is shaped to receive the superior face of an adjacent one of the vertebra when the multiplicity of vertebrae are arranged in the stack.

When the vertebrae are arranged in a stack as shown, the superior face 202 and the inferior face 204 define a vertebra interface 210. This vertebra interface is configured to facilitate a variable deviation $\alpha$ in angular alignment of the vertebra axis 208 of each vertebra 120 relative to an adjacent one of the vertebra 120 in the stack. As may be understood with reference to FIG. 2B, such a variable deviation may occur when the spine 108 is subjected to a deflecting force $F_d$. However, the compression force $F_c$ acting upon the vertebra interfaces 210 will automatically return the spine 108 to its linear condition shown in FIG. 2A once the deflecting force is removed.

The variable deviation in angular alignment as described herein is configured to facilitate a resilient deflection of the spine 108 from the linear alignment of FIG. 1A in which the vertebra axis 208 of each vertebra is aligned along a linear axis 110 defined by the spine, to a curved alignment in which the vertebra axis 208 of each vertebra 120 is tangentially aligned along a curved path defined by the spine 108.

According to one aspect, each of the vertebrae 120 can be comprised of a dielectric material. A dielectric material is selected for this purpose to minimize any electrical interaction between the vertebrae and one or more antenna radiating elements which are supported by the spine 108. In some scenarios, a dielectric index of the dielectric material can be selected to facilitate antenna operations. In other scenarios, the dielectric index may have only minimal effect upon the operation of the antenna system 100.

Figure 3:
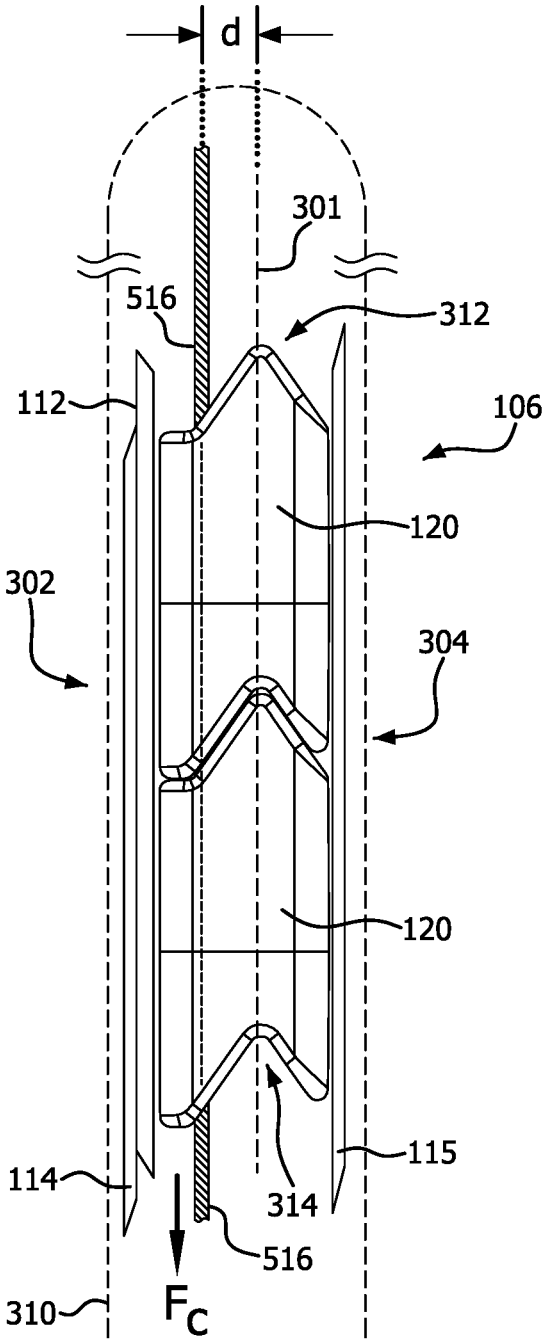
FIG. 3 is a side view of a portion of an antenna spine which is useful for understanding how certain elements can be supported.
Figure 4:
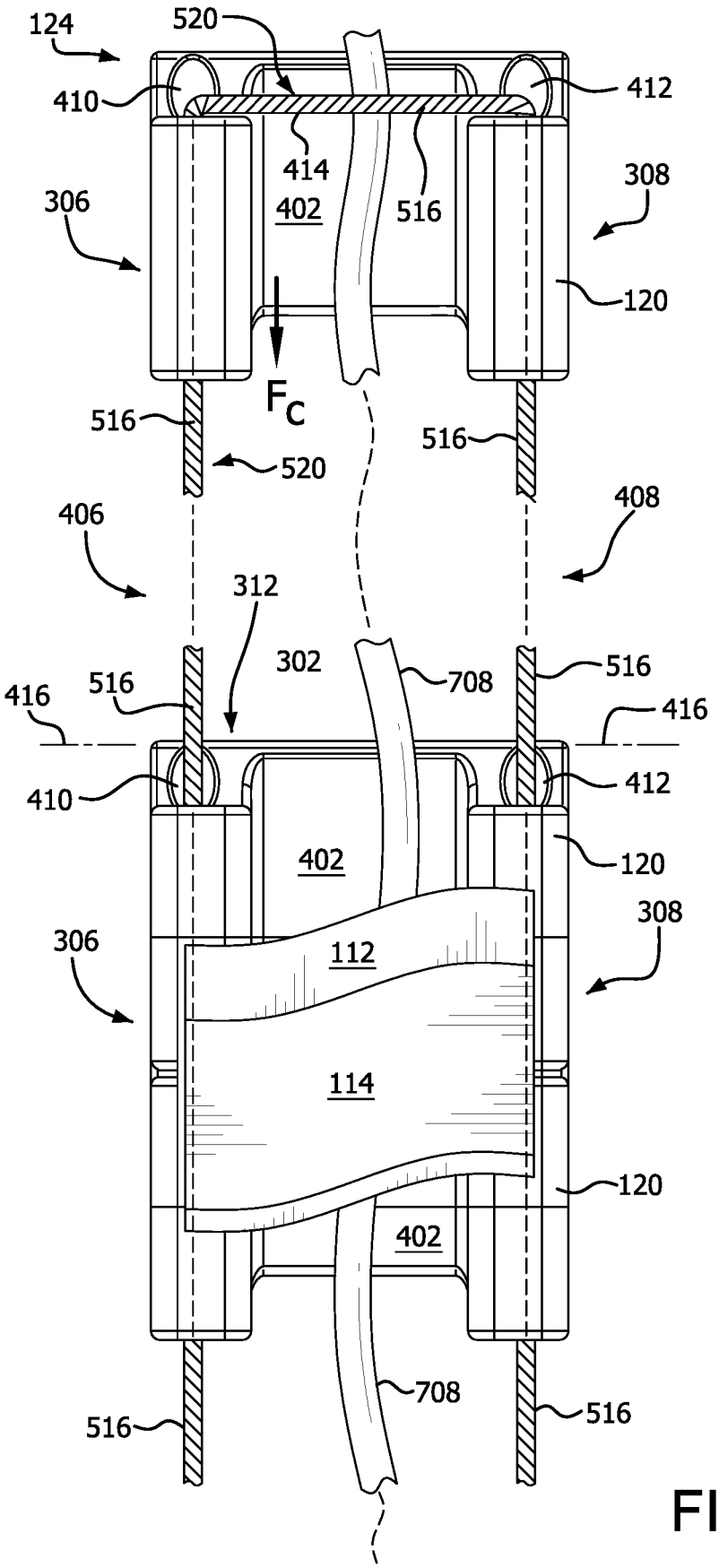
FIG. 4 is a front view of a portion of the antenna spine in FIG. 3.

Additional details of the EEAS 106 are shown in FIGS. 3 and 4. An elongated flexible member 114 can extend adjacent the vertebrae 120 on a first major side 302 thereof along the elongated length of the spine 108. A second elongated flexible member 115 can extend adjacent the vertebrae 120 on a second side 304 thereof opposed from the first side. This second elongated flexible member 115 similarly extends along the elongated length of the spine 108. The first and second elongated flexible members are advantageously formed of planar sheets. The thickness and material comprising the planar sheets is advantageously selected to facilitate the angular deviation of the vertebrae as described herein. However, the thickness and material of the planar sheets is also selected so that the first and second elongated flexible members will limit the maximum variable deviation between adjacent vertebrae 120. Consequently, the first and second elongated flexible members can prevent sharp bends from forming in the spine when a deflection force $F_d$ is applied.

Also shown in FIGS. 3 and 4 is an example of an antenna radiating element 112 which is supported on the spine. In some scenarios, the antenna radiating element can be comprised of a conductive planar sheet. For example, the antenna radiating element can be comprised of a conductive metal material such as copper, aluminum or metal alloy. In other scenarios, the antenna radiating element can be comprised of a flexible conductive metal wire.

According to one aspect, the one or more antenna radiating elements can be disposed on the first major side 302 between flexible elongated member 114 and an adjacent face of each vertebrae 120. In other scenarios, the antenna radiating element 112 can be disposed on the first major side 302 on an outer planar face of the flexible elongated member 114, opposed from the vertebrae 120. In some scenarios, the antenna radiating elements 112, 118 can also be disposed on the second major side 304. As such, the antenna radiating elements can be disposed on one or both opposing major sides 302, 304 of the spine 108. It should be understood that the exact configuration of the one or more antenna radiating elements 112, 118 which are supported on the spine 108 is not critical but will instead depend upon the particular antenna design. It should also be appreciated that a particular antenna design be can be comprised of one or more antenna elements which extend along only a portion of the spine, or extend along an entire length of the spine. Antenna configurations are also contemplated in which one or more flexible conductive antenna elements can be disposed to extend along one or both of a first and second minor side 306, 308 of the vertebrae. Finally, there may be scenarios (not shown) in which one or more radiating elements can extend helically around the outer periphery of the spine 108.

An outer protective fabric covering 310 can be disposed on the EEAS 106 to prevent damage from abrasion and the like. This outer protective fabric covering 310 can also extend around the EEAS 106, the housing 104, and the base 102. This outer protective fabric covering is advantageously selected so that the material is electrically neutral, meaning that it will have no appreciable effect on the electrical performance of the antenna system 100.

Figure 5:
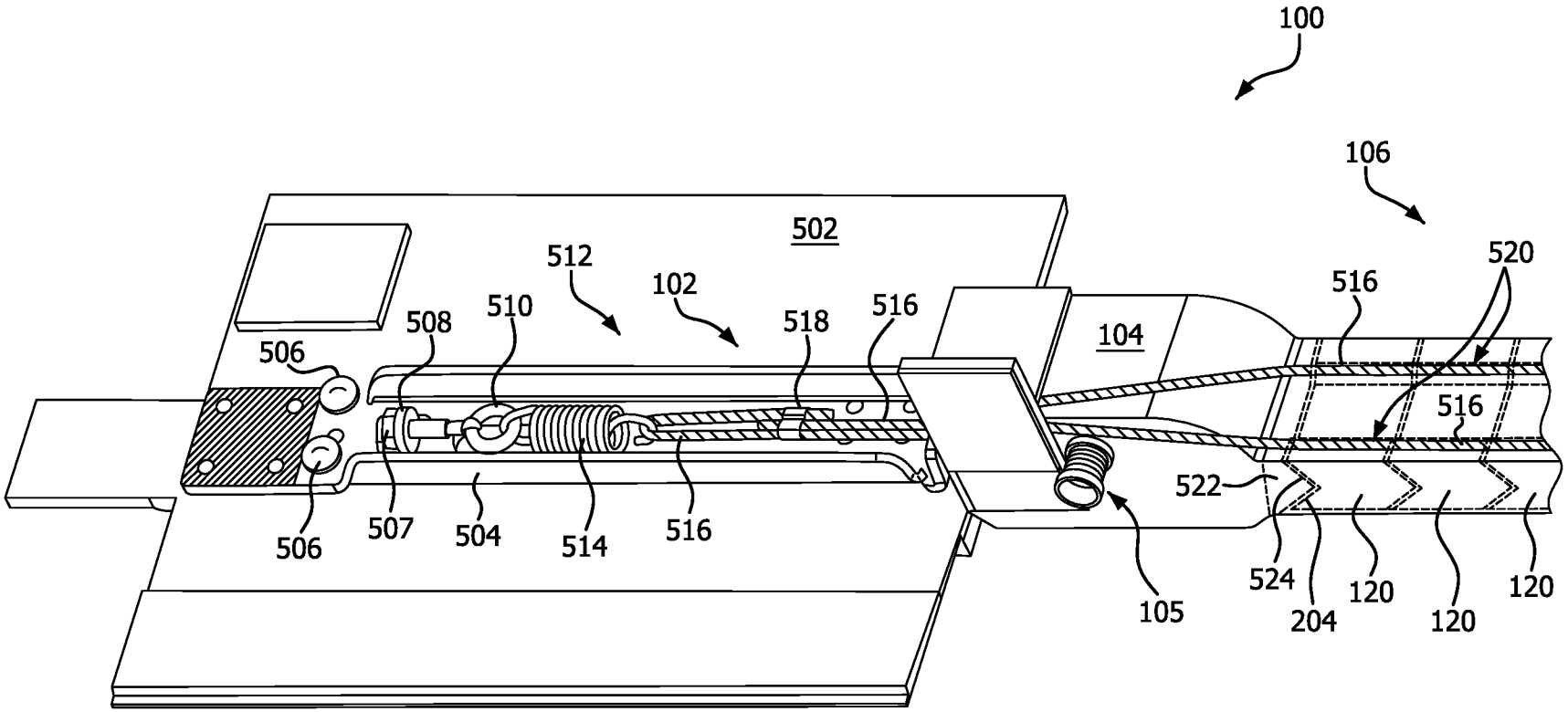
FIG. 5 is a drawing that is useful for understanding certain features of an antenna base which can be used to facilitate the antenna shown in FIGS. 1-4.
Figure 6A:
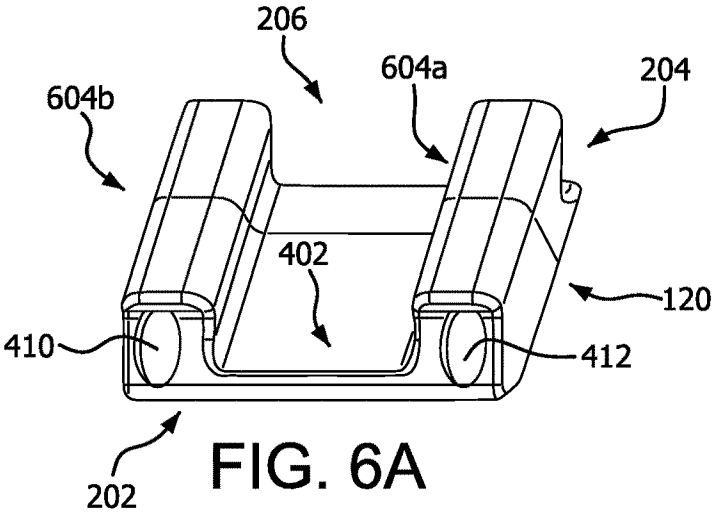
FIG. 6A-6E are a series of drawings that are useful for understanding various features of vertebra which can be used to facilitate an antenna spine.
Figure 6B:
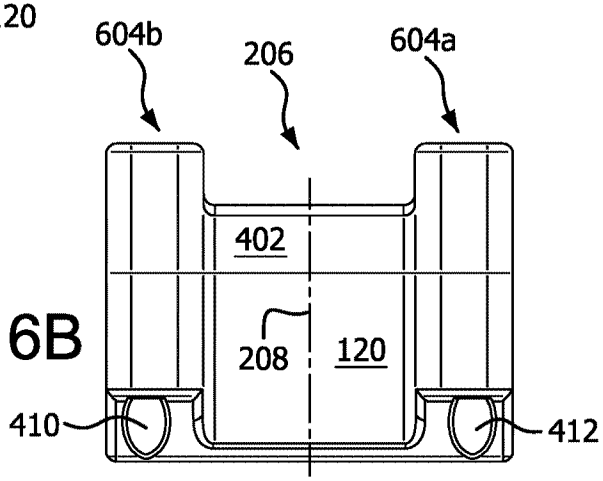
Figure 6C:
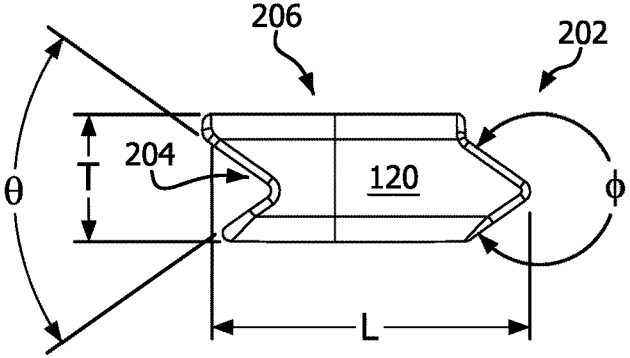
Figure 6D:
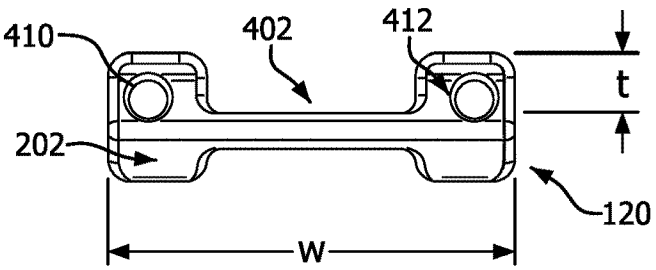
Figure 6E:
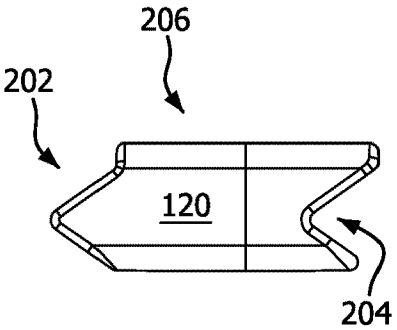

As may be understood with reference to FIG. 5, housing 104 and the stack of vertebra 120 can be supported on the base 102. To facilitate such support, the housing 104 can be provided with a support block 522 having a projecting face 524 which is similar in its profile shape to the superior face 202. As such, the projecting face 524 of the support block 522 can be received by an inferior face 204 of a vertebra 120 which is closest of the support block 522. However, the solution is not limited in this regard and in some scenarios the support block may be mounted directly to the base 102.

The base 102 can be comprised of a frame 504 having an elongated configuration and formed of a rigid material such as a metal or a polymer. In some scenarios, the frame 504 can be secured to a carrier panel 502 using suitable fasteners 506, such as screws, nuts, bolts, and/or rivets. According to one aspect, the elongated frame 504 advantageously includes an anchor plate 508 which may be cut and raised from the material comprising the elongated frame. The anchor plate in such scenarios serves as an attachment point for an anchor 510. The anchor 510 can have a threaded end which is threaded into the anchor plate 508. Alternatively, the anchor can be secured to the anchor plate by means of a threated nut 507. The anchor 510 will serve as a secure mounting point for attaching the compression applicator to the base.

In some scenarios, the compression applicator 512 can be comprised of several components which function cooperatively. According to one aspect, the compression applicator 512 can be comprised of a resilient member 514 and a tension member 516. The resilient member can be comprised of a spring, such as a coil spring, and/or an elastic band formed of a suitable elastic material, such as rubber. The tension member 516 is comprised of a cord or cable which is substantially inelastic. In some scenarios the tension member 516 can be a cord comprised of a polyamide type of material such as Kevlar®. Alternatively, the tension member can be a cord comprised of a low stretch material such as polyester fiber. Other cord materials are also possible and can be used for this purpose. The tension member 516 is secured at one end to the resilient member 514 so as to facilitate application of an elastic force $F_c$ to the vertebrae stack. In some scenarios, the cord which defines the tension member 516 can be arranged to form a cord loop 520 which is secured at one end to the resilient member 514. In this regard a clamp 518 or other suitable attachment mechanism can be used to securely attach opposing ends of the cord loop 520.

The tension member 516 that defines cord loop 520 can extend through each of the vertebrae 120 along the length of the spine. For example, a first portion 406 of the cord loop can extend through a bore 410 extending adjacent to the first minor side 306 of each vertebra 120, and a second portion 408 of the cord loop can extend through a bore 412 extending adjacent to the second minor side 308 of each vertebra. Each of these bores can extend in a direction aligned with a vertebra axis 301 of the vertebra 120. The first and second portions 406, 408 of the loop can be joined together at the tip end 124 of the spine 108 by a cross tie section 414. In the scenario shown in FIG. 4, the elastic compression force $F_c$ is coupled to the spine through the vertebra at the tip end 124 by means of the cross tie section 414. However, the solution is not limited in this regard and other techniques are also possible for coupling this compression force to the stack of vertebra comprising the spine. In this regard the compression applicator shown is merely intended as one possible example of a method by which a compression force can be exerted upon the vertebra stack.

In some scenarios, a vertebra axis 301 can be aligned with a pivot axis 416 of the vertebra 120. The pivot axis can be defined at an apex 312 of each superior vertebra face and/or at a vertex 314 of each inferior face. Each vertebra 120 can pivot about the pivot axis 416 when the shape of the spine is deformed or contoured in the manner shown in FIG. 2B. The arrangement of the bores 410, 412 are advantageously selected such that they are offset by a distance d from this vertebra pivot axis 416. This offset distance d ensures that a force $F_c$ applied by the compression applicator is aligned off-axis of the vertebra pivot axis 416. This offset application of force facilitate a return of the spine to its linear extension when a deflection force is no longer acting upon it.

The vertebra 120 will now be described in further detail with reference to FIGS. 6A-6E. Each vertebra is comprised of a vertebra body 206 which has length L, a width W and a thickness T. In a man-carried implementation of the antenna system, it can be advantageous to minimize an overall size and weight of each vertebra body while still ensuring that the structural requirements and functions of the EEAS 106 are fully satisfied. According to one aspect, each vertebra body can be comprised of a dielectric material. The dielectric material is advantageously selected to be light-weight and rigid so as to provide suitable EEAS stability. Exemplary materials that may be used for this purpose can include various thermoplastic polymer resins. For example, a polycarbonate resin thermoplastic, such as Lexan® has been found to provide suitable results.

The length L of each vertebra body 206 is not critical but can be advantageously selected to facilitate a suitable radius of curvature of the EEAS 106 when a deflecting force is applied. As such, the value of L can depend to some degree on the amount of radius of curvature that is required in a particular application. The length L should also be selected so that it is sufficiently long to facilitate the various structural features associated with the superior and inferior faces 202, 204. For example, in some scenarios the length L can be selected to have a value of between 0.4 inches and 1.2 inches. In other scenarios, the length L can be selected to have a value of between 0.6 inches and 1.0 inches. In still other scenarios, the length L can be selected to have a value of between 0.7 inches and 0.9 inches.

The width W of each vertebra body is similarly not critical but is advantageously chosen to facilitate EEAS lateral stability when the EEAS is fully extended. For example, in some scenarios the width W of each vertebra body can be selected to have a value of between about 0.5 inches to about 1.5 inches. In other scenarios the width W can be selected to have a value of between 0.8 inches to about 1.2 inches.

The thickness T of each vertebra body can be selected to facilitate the various structural features described herein which are associated with the superior and inferior faces 202, 204. The thickness should also be selected to accommodate tension member 516 and to facilitate structural rigidity of the EEAS when extended. Accordingly, a value of T can in some scenarios be selected to be in a range between 0.1 inches and 0.6 inches. In other scenarios the value of T can be chosen to be in the range between 0.2 inches and 0.4 inches.

In an exemplary embodiment, the vertebra body can have a length L=0.8 inches, a width W of 1.0 inches, and a thickness T=0.3 inches. However, it should be understood that the dimensions given herein with respect to the vertebra body 206 merely represent one possible arrangement and the solution is not intended to be limited to these value or the ranges set forth herein.

Each vertebra body 206 includes a first and second ridge 604*a*, 604*b*. These ridges extend along a length of the vertebra body on each of two opposing sides of the vertebra axis 208. Each ridge has a thickness t and is respectively provided with a bore 410, 412 through which the tension member can extend. The value oft is not critical but can be chosen so that it is sufficient to accommodate a bores 410, 412 while maintaining sufficient structural rigidity of the vertebra body 206. In some scenarios, the value oft can be chosen to be in a range between 0.1 and 0.4. In other scenarios, the value oft can be chosen to be in a range of between 0.1 and 0.2.

The superior face 202 of each vertebra 120 can have a profile which is convex. Examples of such convex shaped faces can include V-shaped faces as shown. However, U-shaped faces can also be used for this purpose. The inferior face 204 can similarly have a profile which is similarly V-shaped or U-shaped. However, the inferior face 204 is advantageously a concave shape. As such the superior face 202 and the inferior face 204 are advantageously selected to be complementary shapes. In particular, the shapes of these faces are selected so that the convex superior face of a first vertebra will fit snugly into a concave face forming the inferior face of an adjacent vertebra. In the solution shown in FIGS. 1-5, each vertebra interface 210 is arranged so that the concave-shaped inferior face 204 of a first vertebra is disposed above the convex-shaped inferior face 202. Although this arrangement has been found to work well, it should be understood that the solution is not limited in this regard. Accordingly, in some scenarios the arrangement could be inverted whereby a vertebra interface 210 can include a convex-shaped vertebra face disposed above a concave-shaped vertebra face.

In a scenario as shown in which the vertebra faces are V-shaped, the V-shaped profile of the inferior face 204 can define an angle θ. Similarly, the V-shaped profile of the superior face can define an angle ϕ. The two angles θ and ϕ are advantageously selected such that θ+ϕ=360°. In some scenarios, θ can be an angle between 50° and 90°. Similarly, the angle ϕ can be an angle between about 270° and 310°. In other scenarios, θ can be an angle between 60° and 80°, and the angle ϕ can be an angle between about 280° and 300°. Of course other angles are possible and an optimal angle can be selected empirically or through simulation. For example, a solution in which θ=70° and ϕ=290° has been found to provide suitable results.

Figure 7A:
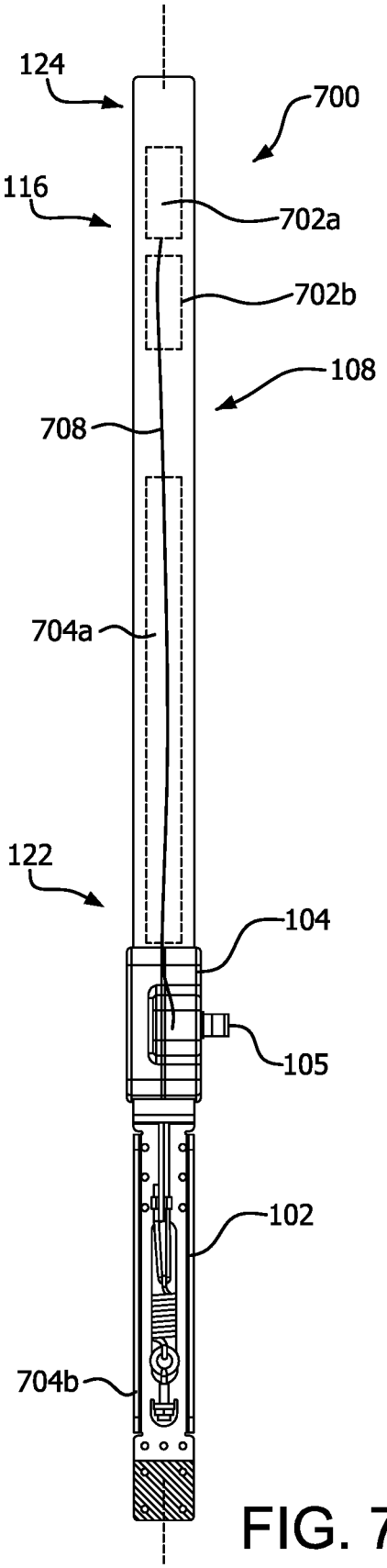
FIGS. 7A and 7B are a series of drawings which are useful for understanding how certain electrical elements can be integrated into an antenna shown in FIGS. 1-5.
Figure 7B:
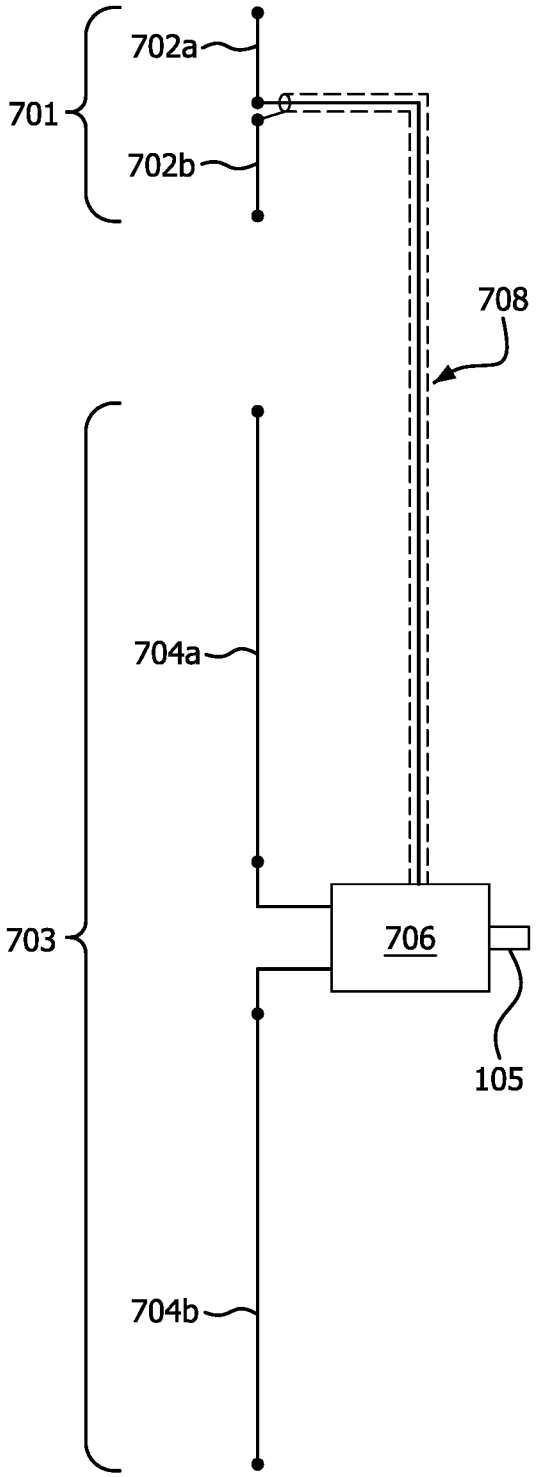

As explained above, each vertebra body is comprised of a dielectric material such as a thermoplastic polymer. As such, the spine 106 of antenna system 100 is electrically neutral. Consequently, one or more radiating elements can be disposed or mounted on the spine without substantial effect upon the electrical antenna performance of the radiating elements. This electrically neutral structure facilitates many different antenna configurations which require a vertical support structure that is extendable but can flex when necessary. One example of the manner in which the support structure can be used is shown in FIGS. 7A and 7B. The antenna 700 shown in FIG. 7A has a structure which is similar to the antenna system 100 described in FIGS. 1-5. In the example shown in FIG. 7A, the support structure facilitated by the antenna 700 is used to implement two separate vertical dipole antennas for operation on two widely separated frequency bands. FIG. 7B shows the electrical aspects of the antenna 700 to facilitate an understanding of the overall configuration.

The antenna 700 includes an RF feed port 105 mounted to the housing 104. The antenna feed port 105 is coupled to an antenna feed network 706, which in this example is comprised of a diplexer and certain impedance matching components. The diplexer is used to route RF signals to each of a high and low band antenna which comprise the antenna 700. Diplexers and impedance matching circuits are well-known in the art and therefore will not be described in detail.

In the example shown in FIGS. 7A and 7B, a low-band vertical dipole 703 is comprised of radiating elements 704*a*, 704*b*. The radiating element 704*a* comprising the first half of the vertical dipole can be implemented in a manner similar to radiating element 112 described herein with regard to FIGS. 3 and 4. As such, the radiating element can be a metal conductor (e.g., a planar metal conductor) which is supported by and extends along a length of the spine 108.

A second half of the low-band vertical dipole 703 can be facilitated by the base 102. If the base 102 is formed of a rigid metal conductor such as aluminum or copper, then the metal structure which defines the base 102 can directly function as the second radiating element 704*b* of the vertical dipole. Alternatively, if the base 102 is formed of a dielectric or nonconductive polymer, then a planar conductive metal strip or wire (not shown) having a predetermined length can be supported along the length of the base. This planar conductive metal strip or wire will then define the second radiating element 704*b* of the low-band vertical dipole 703. As best understood with reference to FIG. 7B, the two radiating elements 704*a*, 704*b* which form the low-band vertical dipole 703 are coupled to the diplexer 706. The diplexer facilitates a low-band RF path between the low-band antenna elements and the RF port 105.

A separate high-band vertical dipole 701 is comprised of radiating elements 702*a*, 702*b*. The radiating element 702*a*, 702*b* comprise first and second halves of the high-band vertical dipole 701. These radiating elements can be implemented in a manner similar to radiating element 112 described herein with regard to FIGS. 3 and 4. As such, the radiating elements 702*a*, 702*b* can each be a metal conductor (e.g., a planar metal conductor) which is supported by and extends along a portion of the length of the spine 108.

An RF feed line 708 extends along the length of the spine 108 to couple the high-band vertical dipole 701 to the diplexer 706. The diplexer 706 routes high-band RF signals between the RF port 105 and the high band vertical dipole. The feed line 708 can be any suitable feed line but is preferably a shielded feed line such as a coaxial cable. The feed line 708 can be routed to the high-band vertical dipole along the length of the spine 108. FIG. 4 is useful to illustrates one advantageous example of a way that the feed line 708 can be routed along the length of the spine in a cable channel 402. This cable channel 402 is defined in each vertebra body 206 between the opposing first and second ridges 704*a*, 704*b*. As shown in FIG. 4, when the vertebrae 120 are arranged in a stack an elongated channel is formed along the length of spine 108. The feed line can extend along this channel from the diplexer 706 to the high-band vertical dipole 701. In some scenarios, one or more ferrite chokes (not shown) can be disposed along the length of the feed line 708 to help minimize RF interaction between the feed line 708, low band antenna structure 703, and the high-band vertical dipole 701.

The example antenna system arrangement shown in FIG. 7 is merely intended as one example of the way in which one or more antennas can be supported on the spine 108 of an antenna 700. The solution however is not limited in this regard and any other suitable arrangement of antenna radiators can be disposed on the support structure facilitated by the base and the spine. Further it is contemplated that the antennas supported on the spine can include a wide variety of different antenna types, and are not limited to dipole antennas. As such, the spine 108 can be used to support a wide variety of different antenna types without limitation.

The described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. An antenna system, comprising:

a base structure;

a multiplicity of vertebrae arranged in a stack to define a spine;

the spine having an elongated length extending from a base end closer to the base structure to a tip end distal from the base structure;

a compression applicator configured to apply a compression force on the spine in a direction along the elongated length from the tip end to the base end while the spine is in a straight position and a bent position to continuously retain arrangement of the vertebrae in the stack when the antenna system is assembled;

each vertebra including a superior face and an inferior face which are respectively disposed on opposing ends of a vertebra body defining a vertebra axis, where the inferior face of each vertebra have an inferior face profile which is shaped to receive the superior face of an adjacent one of the vertebra when the multiplicity of vertebrae are arranged in the stack, and the superior face and the inferior face define a vertebra interface which is configured to facilitate a variable deviation in angular alignment of the vertebra axis of each vertebra relative to an adjacent one of the vertebra in the stack when the spine is subjected to a deflecting force;

an elongated flexible member that extends adjacent the vertebrae along the elongated length of the spine and is configured to allow the spine to bend by a pre-defined limited amount via the variable deviation; and a first antenna radiating element extending along an elongate length of the spine, and disposed on an outer surface of the elongated flexible member or disposed between an inner surface of the elongated flexible member and at least one of the vertebrae.

2. The antenna system of claim 1, wherein the variable deviation in angular alignment is configured to facilitate a resilient deflection of the spine from a linear alignment in which the vertebra axis of each vertebra is aligned along a linear axis defined by the spine, to a curved alignment in which the vertebra axis of each vertebra is tangentially aligned along a curved path defined by the spine.

3. The antenna system of claim 2, wherein the compression applicator is configured to return the spine to the linear alignment after the deflecting force is eliminated.

4. The antenna system of claim 1, further comprising at least one elongated antenna element which is disposed on and extends adjacent to an elongate external surface of the spine.

5. The antenna system of claim 1, wherein the pre-defined limited amount is selected to prevent sharp bends from forming in the spine when subjected to the deflecting force.

6. The antenna system of claim 1, wherein a shape of the superior face is selected from a group consisting of convex, V-shaped and U-shaped.

7. The antenna system of claim 1, wherein the superior face and the inferior face are complementary shapes.

8. The antenna system of claim 1, wherein the compression force is an elastic force.

9. The antenna system of claim 8, wherein the compression applicator is comprised of a cord which extends along the elongated length of the spine.

10. The antenna system of claim 9, wherein the cord extends through a cord guide defined in each vertebra of the multiplicity of vertebrae.

11. The antenna system of claim 9, wherein the compression applicator includes a resilient element secured to the cord, and said resilient element is configured to apply an elastic force which maintains the cord under a condition of tension.

12. The antenna system of claim 11, wherein the resilient element is a spring.

13. The antenna system of claim 12, wherein the spring is secured to the base structure.

14. The antenna system of claim 9, wherein the cord is comprised of an elastic material to provide the elastic force.

15. The antenna system of claim 1, further comprising an antenna feed network coupled to the first antenna radiating element.

16. The antenna system of claim 15, wherein the antenna feed network is coupled to a second antenna radiating element, and the first and second antenna radiating elements together comprise a dipole antenna.

17. The antenna system of claim 16, wherein the second antenna radiating element is the base structure.

18. The antenna system of claim 16, wherein the antenna feed network is disposed within a feed housing that is secured to the base structure, and wherein the spine is supported on the feed housing.

19. The antenna system of claim 15, wherein the first antenna radiating element is associated with a first antenna supported on a first portion of the elongated length of the spine, and a second antenna is supported on a second portion of the elongated length of the spine.

20. The antenna system of claim 19, wherein the antenna feed network includes a diplexer configured to electrically isolate the first antenna from the second antenna.

21. The antenna system of claim 19, wherein each vertebra defines a feed channel configured to receive a portion of an RF feed line which extends along a portion of the elongated length of the spine between the antenna feed network and the second antenna.

22. The antenna system of claim 1, wherein each vertebra is comprised of a dielectric material.

23. The antenna system of claim 1, wherein the first antenna radiating element is supported on a portion of the elongated length of the spine when the first antenna radiating element is disposed between the inner surface of the elongated flexible member and at least one of the vertebrae.

24. The antenna system of claim 1, wherein the elongate flexible member is positioned between the spine and the first antenna radiating element when the first antenna radiating element is disposed on the outer surface of the elongate flexible member.

25. The antenna system of claim 1, wherein the first antenna radiating element extends helically around an outer periphery of the spine.

26. An antenna system, comprising:

a base structure;

a multiplicity of vertebrae arranged in a stack to define a spine, each adjacent pair of the vertebrae defining a vertebra interface where the adjacent pair of the vertebra are in contact;

the spine having an elongated length extending from a base end closer to the base structure to a tip end distal from the base structure;

a compression applicator which is configured to apply an elastic compression force on the stack in a direction along the elongated length from the tip end to the base end while the spine is in a straight position and a bent position to continuously retain arrangement of the vertebrae in the stack when the antenna system is assemble;

the vertebra interfaces associated with each of the adjacent pairs of the vertebrae are each configured to facilitate a variable deviation in an angular alignment of a vertebra axis of each vertebra relative to an adjacent one of the vertebra contained in the stack;

an elongated flexible member that extends adjacent the vertebrae along the elongated length of the spine and is configured to allow the spine to bend by a pre-defined limited amount via the variable deviation; and a first antenna radiating element extending along an elongate length of the spine, and disposed on an outer surface of the elongated flexible member or disposed between an inner surface of the elongated flexible member and at least one of the vertebrae.

* * * * *